US007255145B2

(12) United States Patent
Oh

(10) Patent No.: US 7,255,145 B2
(45) Date of Patent: Aug. 14, 2007

(54) FASTENING APPARATUS HAVING MULTIPLE TRACKS

(76) Inventor: Scott Oh, 3200 Wilshire Blvd., Suite North Tower 1501, Los Angeles, CA (US) 90010

( * ) Notice: Subject to any disclaimer, the term of this patent is extended or adjusted under 35 U.S.C. 154(b) by 0 days.

(21) Appl. No.: 10/930,496

(22) Filed: Aug. 30, 2004

(65) Prior Publication Data

US 2006/0042732 A1 Mar. 2, 2006

(51) Int. Cl.
*A34C 13/26* (2006.01)
*A45C 1/02* (2006.01)
*A45C 13/10* (2006.01)

(52) U.S. Cl. ..... 150/107; 150/117; 189/111; 189/115; 189/119; 189/893; 383/38; 383/7; 24/382

(58) Field of Classification Search ..... 150/107, 150/108, 117; 190/115, 903, 911, 900, 111, 190/39, 119; 24/382; 383/38, 97
See application file for complete search history.

(56) References Cited

U.S. PATENT DOCUMENTS

| | | | | | |
|---|---|---|---|---|---|
| 2,096,895 | A | * | 10/1937 | Halpin | 383/14 |
| 2,769,474 | A | * | 11/1956 | Klotz | 190/115 |
| 4,492,006 | A | * | 1/1985 | Ishii | 24/382 |
| 4,545,414 | A | * | 10/1985 | Baum | 224/580 |
| 4,714,143 | A | * | 12/1987 | Saliba | 190/115 |
| 4,756,394 | A | * | 7/1988 | Cohen | 190/18 A |
| 4,830,153 | A | * | 5/1989 | Saliba | 190/102 |
| 4,961,522 | A | * | 10/1990 | Weber | 224/585 |
| 2003/0057239 | A1 | * | 3/2003 | Godshaw | 224/153 |

* cited by examiner

*Primary Examiner*—Sue A. Weaver
(74) *Attorney, Agent, or Firm*—Lee, Hong, Degerman, Kang & Schmadeka

(57) ABSTRACT

A multi-track fastening apparatus which may be implemented on a bag with a hideable handle wherein the fastening apparatus is capable of closing a pocket of the bag when the handle is hidden within the pocket and when the handle is exposed out of the pocket.

15 Claims, 3 Drawing Sheets

FASTENING APPARATUS HAVING MULTIPLE TRACKS

BACKGROUND OF THE INVENTION

1. Field of the Invention

The present invention relates to a fastening apparatus utilizing multiple tracks, and more particularly, to a fastening apparatus for use with a bag having a hideable handle.

2. Description of the Related Art

Generally, fastening apparatuses using multiple tracks have been designed for multiple uses. One such device is a zipper apparatus having three rows of zipper teeth, one row of which is shared by two opposing zipper sliders at opposite ends of the shared row of teeth. This device may be used to vary the size of a bag. Another zipper device has two parallel zippers such that one is placed on top of the other. This device allows a piece of clothing to vary between two sizes to accommodate weight gain or loss by the person who wears the clothing.

Various zipper apparatuses have also been used in conjunction with bags. Typically, these zipper apparatuses are used as closure devices for sealing the bag or sealing a compartment of the bag. In the case where the bag has a handle, a zipper apparatus has been known to help conceal or hide the handle within a pocket of the bag by closing the pocket in which the handle has been tucked away in. Such a zipper apparatus is useful when the handle is hidden as it can continue to open and close the bag pocket while the handle placed therein. A problem occurs when the handle is to be utilized. In such a case, the pocket is unzipped and the handle is pulled out of the pocket for use. However, while the handle is exposed, the zipper apparatus is unable to close the pocket because the handle obstructs the tracks of the zipper apparatus from engaging one another. This is typically the case when a zipper apparatus having only two tracks is used. Thus, the pocket bag is left open leaving the user susceptible to disadvantages such as belongings falling out of the pocket, theft, and lack of privacy.

Therefore, what is needed is a fastening apparatus using multiple tracks. Such an apparatus allows a bag pocket to be closed when a hideable handle is hidden in the pocket as well as close the bag pocket when the hideable handle is exposed out of the pocket.

SUMMARY OF THE INVENTION

The present invention is directed to a fastening apparatus utlilizing multiple fastening tracks.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is a multi-track fastening apparatus, comprising a first fastening track, a second fastening track, and a third fastening track, wherein the first fastening track is capable of fastening onto either of the second fastening track and the third fastening track.

In one aspect of the present invention, the first fastening track and the second fastening track are capable of being fastened together when the first fastening track and the third fastening track are unfastened apart.

In another aspect of the present invention, the first fastening track and the third fastening track are capable of being fastened together when the first fastening track and the second fastening track are unfastened apart.

In another embodiment, the present invention is a multi-track fastening apparatus comprising a first zipper slider for zipping together and unzipping apart a first zipper track and a second zipper track, and a second zipper slider for zipping together and unzipping apart the first zipper track and a third zipper track.

In one aspect, the first zipper track and the second zipper track are capable of being zipped together by the first zipper slider when the first zipper track and the third zipper track are unzipped apart by the second zipper slider.

In another aspect, the first zipper track and the third zipper track are capable of being zipped together by the second zipper slider when the first zipper track and the second zipper track are unzipped apart by the first zipper slider.

In a further aspect, the first zipper slider and the second zipper slider are at opposite ends of the first zipper track when the first zipper track and the second zipper track are unzipped apart and the first zipper track and the third zipper track are unzipped apart.

In yet another aspect, the first zipper slider and the second zipper slider come together at an end of the first zipper track when the first zipper track and the second zipper track are zipped together.

In yet a further aspect, the first zipper slider and the third zipper slider come together at an end of the first zipper track when the first zipper track and the third zipper track are zipped together.

In another embodiment, the present invention is a bag with a hideable handle using a fastening apparatus comprising a bag, a pocket formed at a side of the bag, a handle attached to a portion of the bag, and a fastening apparatus capable of closing the pocket when the handle is hidden in the pocket and when the handle is exposed out of the pocket.

In one aspect, the fastening apparatus is a zipper apparatus, the zipper apparatus comprising a first zipper slider for zipping together and unzipping apart a first zipper track and a second zipper track, and a second zipper slider for zipping together and unzipping apart the first zipper track and a third zipper track.

In another aspect, the first zipper track and the second zipper track are capable of being zipped together by the first zipper slider when the first zipper track and the third zipper track are unzipped apart by the second zipper slider.

In a further aspect, the first zipper track and the third zipper track are capable of being zipped together by the second zipper slider when the first zipper track and the second zipper track are unzipped apart by the first zipper slider.

In an additional aspect, the handle is hidden in the pocket when the first zipper track and the second zipper track are zipped together by the first zipper slider.

In yet another aspect, the handle is exposed out of the pocket when the first zipper track and the third zipper track are zipped together by the second zipper slider.

In yet a further aspect, the handle is attached to the portion of the bag in between the second zipper track and the third zipper track.

In yet an additional aspect, the first zipper slider and the second zipper slider are at opposite ends of the first zipper track when the first zipper track and the second zipper track are unzipped apart and the first zipper track and the third zipper track are unzipped apart.

In a detailed aspect, the first zipper slider and the second zipper slider come together at an end of the first zipper track when the first zipper track and the second zipper track are zipped together.

In a more detailed aspect, the first zipper slider and the third zipper slider come together at an end of the first zipper track when the first zipper track and the third zipper track are zipped together.

In another aspect, the fastening apparatus comprises a first fastening track, a second fastening track, and a third fastening track, wherein the first fastening track is capable of fastening onto either of the second fastening track and the third fastening track.

In a further aspect, the first fastening track and the second fastening track are capable of being fastened together when the first fastening track and the third fastening track are unfastened apart.

In an additional aspect, the first fastening track and the third fastening track are capable of being fastened together when the first fastening track and the second fastening track are unfastened apart.

In a detailed aspect, the handle is hidden in the pocket when the first fastening track and the second fastening track are fastened together.

In another detailed aspect, the handle is exposed out of the pocket when the first fastening track and the third fastening track are fastened together.

In yet another detailed aspect, the handle is attached to a portion of the bag in between the second fastening track and the third fastening track.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

Figure 1:
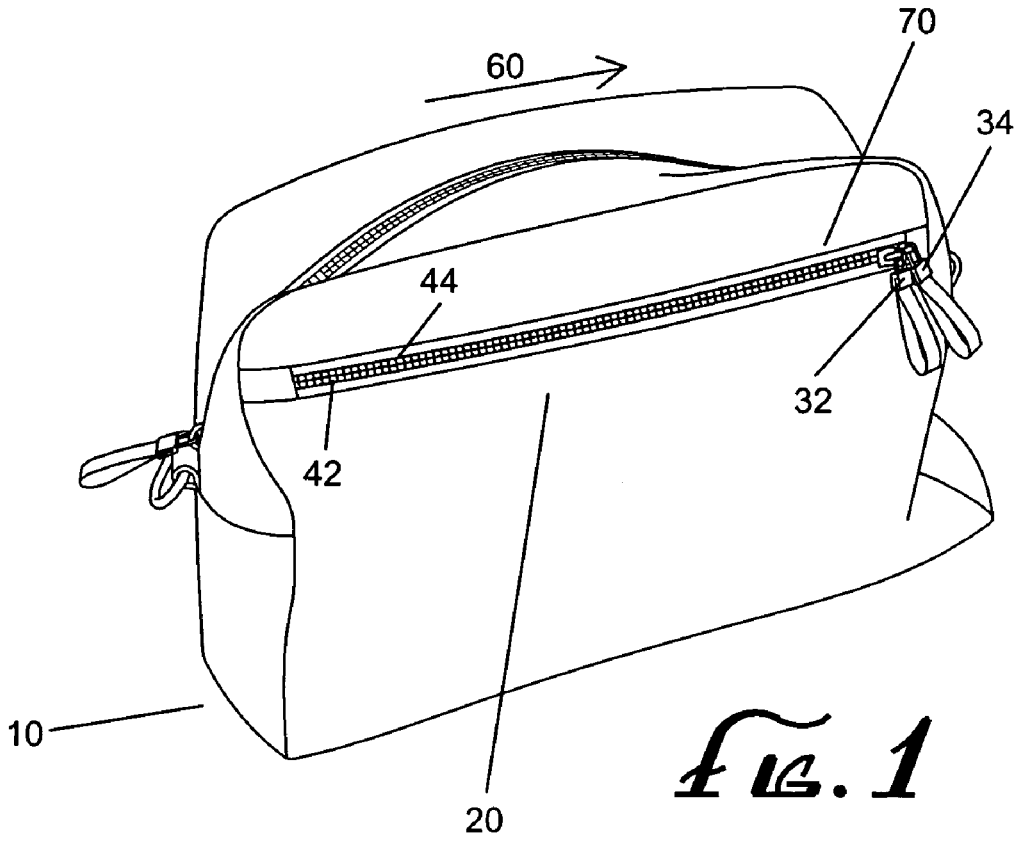
FIG. 1 is a perspective view of a bag with a hidden handle wherein a first zipper slider of a zipper apparatus is in a closed position in accordance with an embodiment of the present invention.

The present invention relates to a fastening apparatus having multiple tracks. The multi-track fastening apparatus comprises a first fastening track, a second fastening track, and a third fastening track wherein the first fastening track is capable of fastening onto either of the second fastening track and the third fastening track. Accordingly, the first fastening track and the second fastening track are capable of being fastened together when the first fastening track and the third fastening track are unfastened apart. Further, the first fastening track and the third fastening track are capable of being fastened together when the first fastening track and the second fastening track are unfastened apart.

Preferably, the fastening apparatus is a zipper apparatus 70 comprising three zipper tracks, one track of which is shared by two opposing zipper sliders at opposite ends of the shared zipper track. In the figures, the zipper apparatus is implemented on a bag for opening and closing a pocket of the bag; however, it is contemplated that the zipper apparatus of the present invention may be implemented on any article wherein two portions of the article are to be brought together.

Referring to FIGS. 1-4, an embodiment of the present invention comprises a first zipper slider 32, a second zipper slider 34, a first zipper track 42, a second zipper track 44 and a third zipper track 46. The first zipper slider 32 engages the first zipper track 42 and the second zipper track 44 such that when the first zipper slider 32 is pulled in a first direction, as depicted by arrow 60 in FIG. 1, the first zipper slider 32 couples or zips together the first zipper track 42 and the second zipper track 44. By pulling the first zipper slider 32 in a second direction opposite to the arrow 60, the first zipper slider 32 uncouples or unzips apart the first zipper track and the second zipper track.

Figure 3:
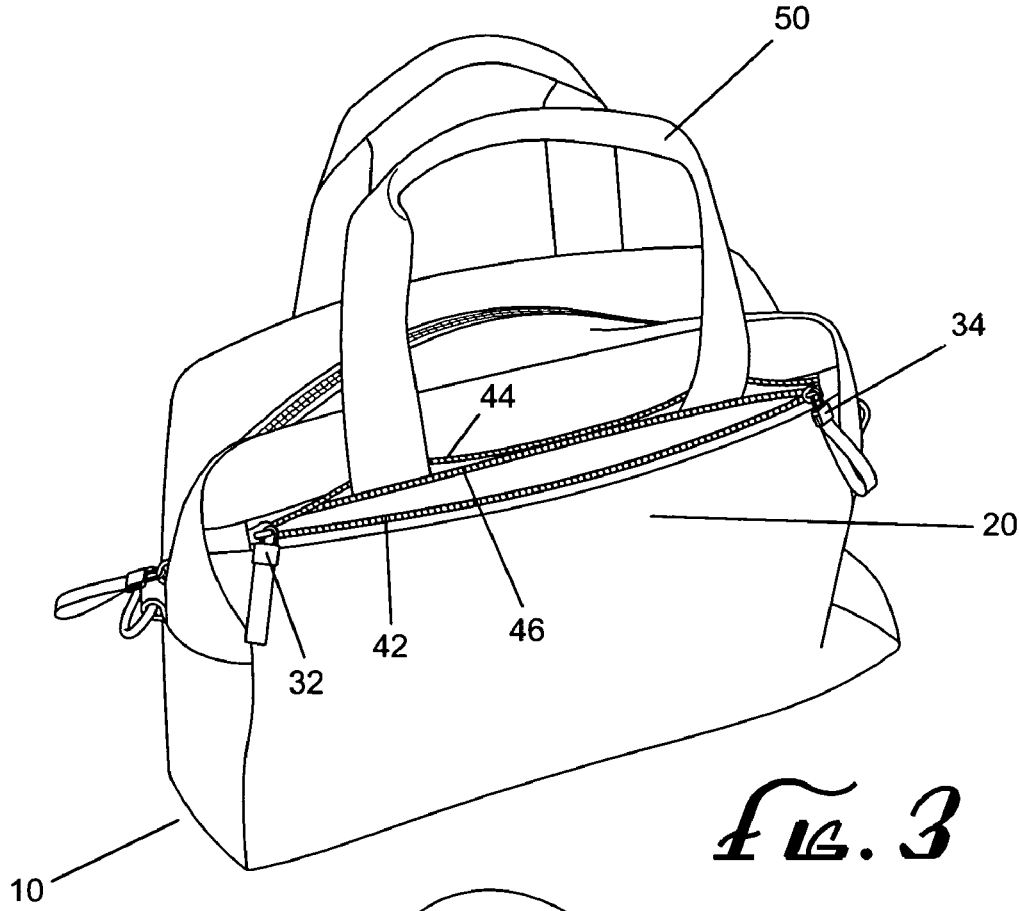
FIG. 3 is a perspective view of a bag with an exposed handle in accordance with an embodiment of the present invention.

The second zipper slider 34 engages the first zipper track 42 and the third zipper track 46, as shown in FIG. 3. When the second zipper slider 34 is pulled in the first direction, as depicted by the arrow 60, the second zipper slider 34 uncouples or unzips apart the first zipper track 42 and the third zipper track 46. By pulling the second zipper 34 in the second direction opposite to the arrow 60, the second zipper slider 34 couples or zips together the first zipper track and the third zipper track.

Preferably, the zipper apparatus 70 is designed such that when the first zipper track 42 and the second zipper track 44 are zipped together by the first zipper slider 32, the first zipper track 42 and the third zipper track 46 are unzipped apart by the second zipper slider 34. Likewise, when the first zipper track 42 and the third zipper track 46 are zipped together by the second zipper slider 34, the first zipper track 42 and the second zipper track 44 are unzipped apart by the first zipper slider 32.

As shown in the figures, the first zipper slider 32 and the second zipper slider 34 are positioned at opposite ends of the shared first zipper track 42 when neither the second zipper track 44 nor the third zipper track 46 are zipped together with the first zipper track 42. However, the first zipper slider 32 and the second zipper slider 34 come together at an end of the first zipper track 42 when the first zipper track 42 and the second zipper track 44 are zipped together. Moreover, the first zipper slider 32 and the second zipper slider 34 also come together at another end of the first zipper track 42 when the first zipper track 42 and the third zipper track 46 are zipped together.

Figure 2:
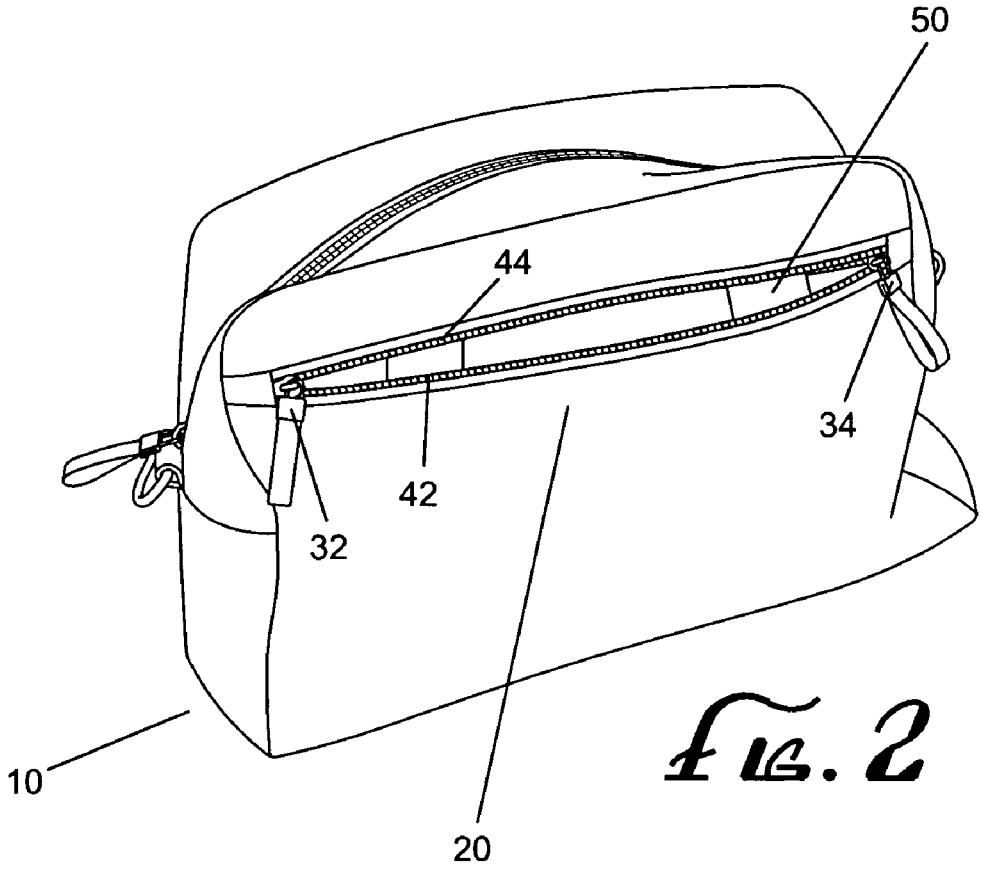
FIG. 2 is a perspective view of a bag wherein the first zipper slider of the zipper apparatus is in an open position in accordance with an embodiment of the present invention.
Figure 4:
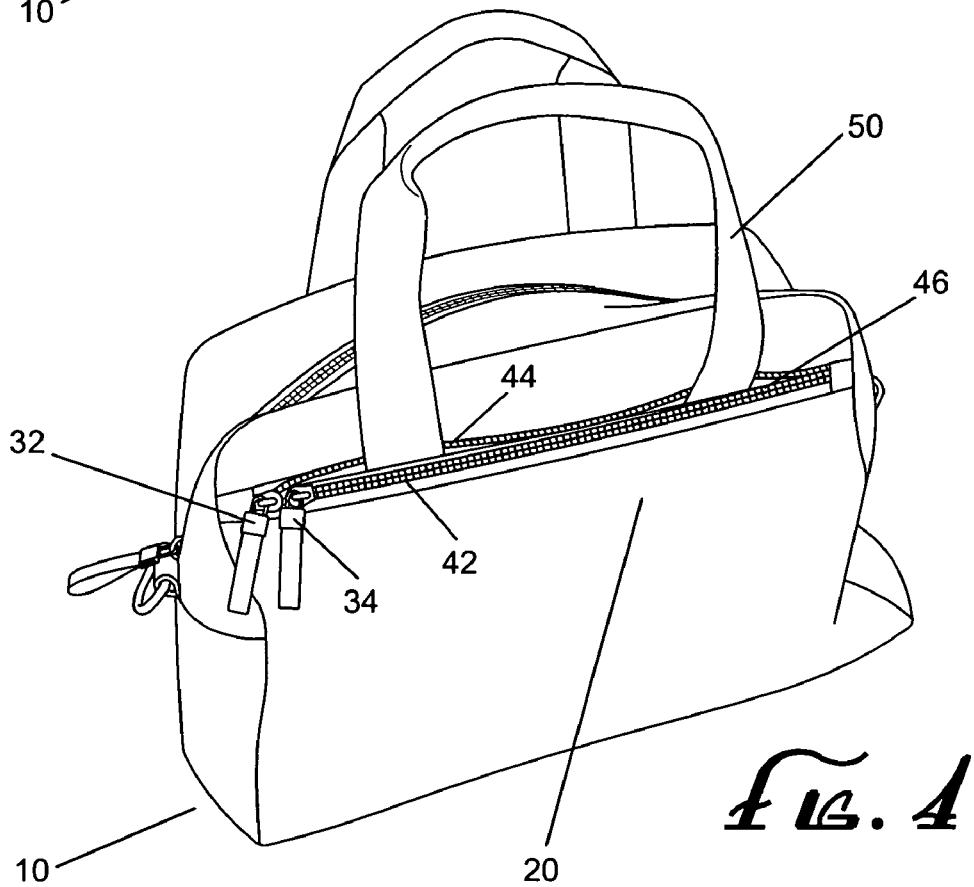
FIG. 4 is a perspective view of a bag with an exposed handle wherein a second zipper slider of a zipper apparatus is in a closed position in accordance with an embodiment of the present invention.

In another embodiment, the present invention comprises a bag 10, a pocket 20 formed at a side of the bag 10, a handle 50 attached to a portion of the bag 10, and a fastening apparatus. Preferably, the fastening apparatus is a zipper apparatus 70. The handle 50 is attached to the bag 10 such that a user has the option of exposing the handle 50, as shown in FIGS. 3 and 4. The user further has the option of hiding the handle within the pocket 20, as shown in FIGS. 1 and 2. Preferably, the handle is attached or sewn to a portion of the bag 10 within the pocket 20 in between the second zipper track 44 and the third zipper track 46.

Referring to FIG. 1, the pocket 20 is in a closed position when the first zipper slider 32 is pulled in the direction depicted by the arrow 60 to couple or zip together the first zipper track 42 and the second zipper track 44. Meanwhile, although the pocket 20 is closed, the first zipper track 42 and the third zipper track 46 are uncoupled or unzipped apart from each other. In such a state, the handle 50 may be hidden within the pocket 20 while the pocket is closed by the first zipper track 42 and the second zipper track 44.

As shown in FIG. 2, if the user wishes to access the pocket or perhaps expose the handle 50, the user may pull the first zipper slider 32 in a direction opposite to the arrow 60. As a result, the first zipper track 42 and the second zipper track 44 are uncoupled or unzipped apart.

Referring to FIG. 3, the handle 50 may be pulled out of the pocket 20 for use. As shown, the handle 50 is preferably attached to a portion of the bag 10 within the pocket 20 in between the second zipper track 44 and the third zipper track 46. Such a design allows the first zipper track 42 and the third zipper track 46 to engage one another without the handle 50 obstructing the engagement. If the user wishes, the user may leave the pocket in the open position while the handle 50 is pulled out of the pocket 20, as shown in FIG. 3. However, if the user wishes to close the pocket 20 while the handle 50 is exposed, the user may pull the second zipper slider 34 in a direction opposite to the arrow 60 to couple or zip together the first zipper track 42 and the third zipper track 46. Such is shown in FIG. 4. Although the pocket 20 is closed, the first zipper track 42 is in an open position in relation to the second zipper track 44. In such a state, the handle 50 may be exposed outside the pocket 20 while the pocket is closed by the first zipper track 42 and the third zipper track 46.

Figure 5:
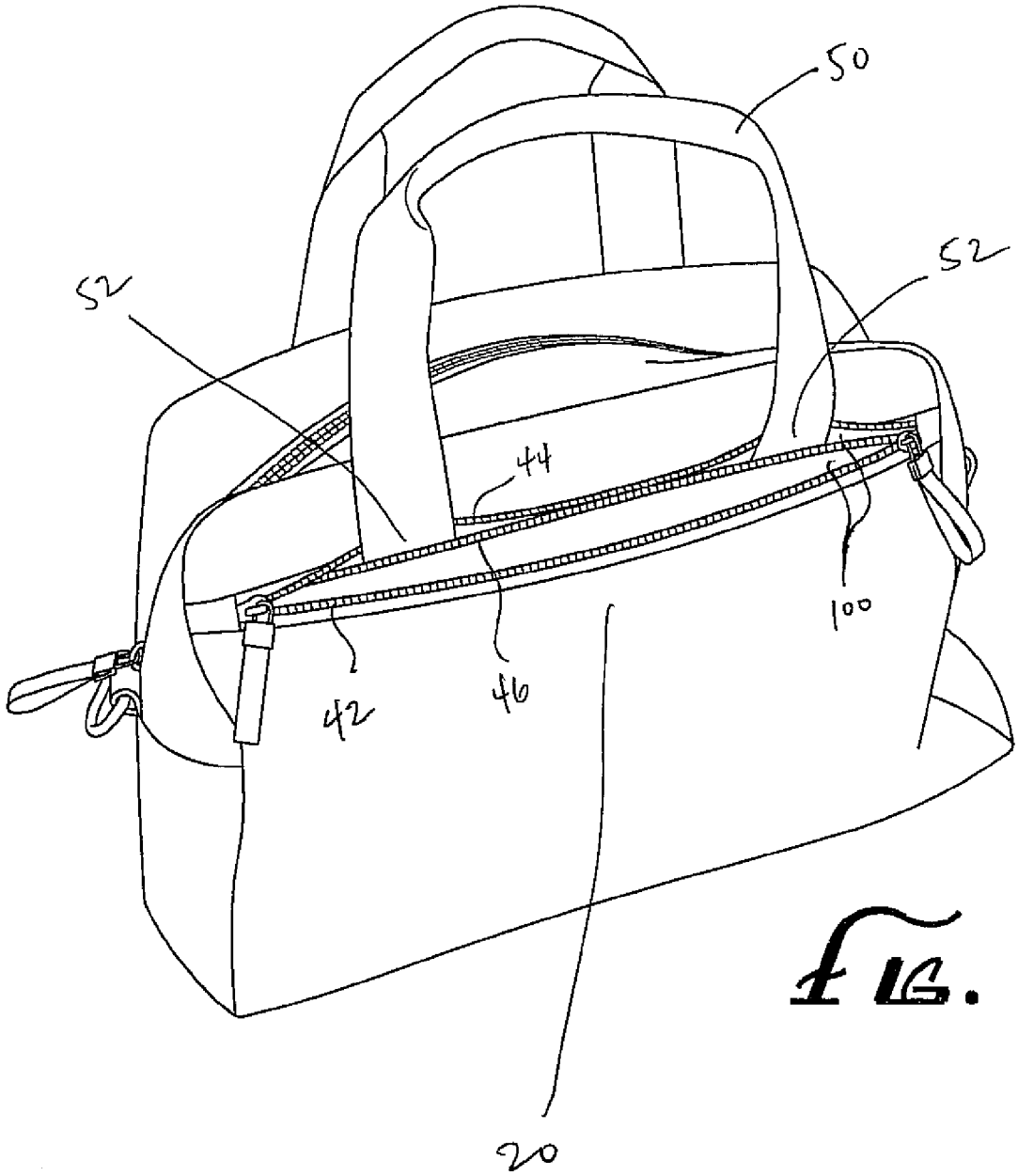
FIG. 5 is a perspective view of a bag illustrating details of a zipper apparatus in accordance with an embodiment of the present invention.

Referring to FIG. 5, details of the zipper apparatus 70 in accordance with one embodiment of the present invention will be described. As shown, the first zipper track 42 and the second zipper track 44 are attached to opposite edges of an opening of the pocket 20. The third zipper track 46 is attached to an interior wall 100 located within the pocket 20. Handle ends 52 are also attached to the interior wall 100 within the pocket 20. Preferably, the handle ends 52 are attached to points on the interior wall 100 located above where the third zipper track 46 is attached. By attaching the handle ends 52 at this location, the third zipper track 46 is able to engage the first zipper track 42 without obstruction from the handle 50 when the handle 50 is exposed out of the pocket 20, as shown in FIG. 4.

Preferably, the line along where the third zipper track 46 is attached on the interior wall 100 acts as an edge of the pocket opening when the handle 50 is exposed out of the pocket 20. Hence, the opening of the pocket 20 cannot be accessed from a point above the zipper track 46 when the handle 50 is exposed out of the pocket 20. However, the opening of the pocket 20 may be accessed from a point below the zipper track 46. Accordingly, while the handle 50 is exposed out of the pocket 20, the opening of the pocket 20 may be closed when the third zipper track 46 engages the first zipper track 42, and therefore, the opening of the pocket 20 from below the third zipper track 46 is sealed.

In another embodiment, the present invention comprises a bag, a pocket formed at a side of the bag, a handle attached to a portion of the bag, and a fastening apparatus wherein the fastening apparatus is a snap-button apparatus. Preferably, the snap-button apparatus comprises three rows of snap-buttons, one row of which is capable of coupling with the other two rows of snap-buttons. It is contemplated that a first row may be a row of male snap-buttons designed to couple with either a second or a third row of female snap-buttons. Alternatively, a first row may be a row of female snap-buttons designed to couple with either a second row or third row of male snap-buttons. The handle is attached to the bag such that a user has the option of exposing the handle out of the pocket or hiding the handle within the pocket. Preferably the handle is attached or sewn to a portion of the bag within the pocket in between the second and third rows of snap-buttons.

The pocket is in a closed position when the first row of snap-buttons is fastened onto the second row of snap-buttons. Meanwhile, although the pocket is closed, the first row of snap-buttons and the third row of snap-buttons are unfastened. In such a state, the handle may be hidden within the pocket while the pocket is closed by the first and second rows of snap-buttons.

If the user wishes to expose the handle, the user may unfasten the first and second rows of snap-buttons. The user may then pull handle out of the pocket for use. The handle is preferably attached to a portion of the bag within the pocket in between the second and third rows of buttons. Such a design allows the first row of snap-buttons to engage the third row of snap-buttons without the handle obstructing the engagement. If the user wishes, the user may leave the pocket in the open position while the handle is pulled out of the pocket. However, if the user wishes to close the pocket while the handle is exposed, the user may fasten together first row of snap-buttons and the third row of snap-buttons. Although the pocket is closed, the first row of snap-buttons is unfastened from the second row of snap-buttons. In such a state, the handle may be exposed out of the pocket while the pocket is closed by first and third rows of snap-buttons.

It is noted that the use of snap-buttons is merely an example of the types of fasteners usable with the present invention. Thus, other types of fastening devices may be used such as hook and loop fasteners and other types of buttons.

It is further noted that the use of a fastening apparatus with a bag as described above is also merely an example of how to use the fastening apparatus of the present invention. It is contemplated that the present invention may be used with other types of containers such as backpacks with hideable shoulder straps or other types of luggage that use handles or carrying straps.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A bag with a hideable handle using a fastening apparatus, comprising:

a bag;

a pocket formed at a side of the bag;

a handle attached to a portion of the bag; and a fastening apparatus attached to the bag adjacent to an opening of the pocket, the fastening apparatus comprising a first zipper slider for zipping together and unzipping apart a first zipper track and a second zipper track of the fastening apparatus, and a second zipper slider for zipping together and unzipping apart the first zipper track and a third zipper track of the fastening apparatus, wherein the fastening apparatus is capable of closing the pocket when the handle is hidden in the pocket and when the handle is exposed out of the pocket.

2. The bag of claim 1, wherein the first zipper track and the second zipper track are capable of being zipped together by the first zipper slider when the first zipper track and the third zipper track are unzipped apart by the second zipper slider.

3. The bag of claim 1, wherein the first zipper track and the third zipper track are capable of being zipped together by the second zipper slider when the first zipper track and the second zipper track are unzipped apart by the first zipper slider.

4. The bag of claim 1, wherein the handle is hidden in the pocket when the first zipper track and the second zipper track are zipped together by the first zipper slider.

5. The bag of claim 1, wherein the handle is exposed out of the pocket when the first zipper track and the third zipper track are zipped together by the second zipper slider.

6. The bag of claim 1, wherein the handle is attached to the portion of the bag in between the second zipper track and the third zipper track.

7. The bag of claim 1, wherein the first zipper slider and the second zipper slider are at opposite ends of the first zipper track when the first zipper track and the second zipper track are unzipped apart and the first zipper track and the third zipper track are unzipped apart.

8. The bag of claim 1, wherein the first zipper slider and the second zipper slider come together at an end of the first zipper track when the first zipper track and the second zipper track are zipped together.

9. The bag of claim 1 wherein the first zipper slider and the third zipper slider come together at an end of the first zipper track when the first zipper track and the third zipper track are zipped together.

10. A bag with a hideable handle using a fastening apparatus, comprising:

a bag;

a pocket formed at a side of the bag;

a handle attached to a portion of the bag; and a fastening apparatus attached to the bag adjacent to an opening of the pocket, the fastening apparatus comprising a first fastening track, a second fastening tracK and a third fastening track, wherein the first fastening track is capable of fastening onto either of the second fastening track and the third fastening track;

wherein the fastening apparatus is capable of closing the docket when the handle is hidden in the pocket and when the handle is exposed out of the pocket.

11. The bag of claim 10, wherein the first fastening track and the second fastening track are capable of being fastened together when the first fastening track and the third fastening track are unfastened apart.

12. The bag of claim 10, wherein the first fastening track and the third fastening track are capable of being fastened together when the first fastening track and the second fastening track are unfastened apart.

13. The bag of claim 10, wherein the handle is hidden in the pocket when the first fastening track and the second fastening track are fastened together.

14. The bag of claim 10, wherein the handle is exposed out of the pocket when the first fastening track and the third fastening track are fastened together.

15. The bag of claim 10, wherein the handle is attached to the portion of the bag in between the second fastening track and the third fastening track.

* * * * *